US005445174A

United States Patent [19]

Cunningham

[11] Patent Number: 5,445,174

[45] Date of Patent: Aug. 29, 1995

[54] RISING BRACE AND METHOD FOR AN INVALID WALKER

[76] Inventor: Thomas W. Cunningham, 3580 Emerywood La., Orlando, Fla. 32812

[21] Appl. No.: 202,921

[22] Filed: Feb. 25, 1994

[51] Int. Cl.[6] ..... A45B 3/00

[52] U.S. Cl. ..... 135/66; 135/67; 135/72

[58] Field of Search ..... 135/66, 67, 72, 76; 482/66, 68, 69; 280/87.021, 87.051, 304.1; 297/DIG. 10, DIG. 4; 224/42.46

[56] References Cited

U.S. PATENT DOCUMENTS

| | | | |
|---|---|---|---|
| 2,556,121 | 6/1951 | Thomas . | |
| 3,179,436 | 4/1965 | Choy | 135/66 X |
| 3,376,066 | 4/1968 | Kernes . | |
| 3,708,182 | 1/1973 | Markiel . | |
| 4,231,614 | 11/1980 | Shaffer . | |
| 4,619,282 | 10/1986 | Battiston | 135/67 |
| 4,910,927 | 3/1990 | Beathy | 135/66 |
| 4,941,495 | 7/1990 | Boyce et al. | 135/72 X |
| 4,941,496 | 7/1990 | Berning | 135/72 X |

*Primary Examiner*—Lanna Mai

*Attorney, Agent, or Firm*—Allen, Dyer, Doppelt, Franjola & Milbrath

[57] ABSTRACT

A brace for assisting a disabled person in rising from a sitting position to a standing position has a handle extending from a vertical support such as a leg of a walker. The handle is moveable affixed to the vertical support by a coupling for positioning the handle for rising and for storage on the walker while walking. The handle is positioned above a lower horizontal member of the brace for enabling the person to rise from the sitting position. A handle grip is formed to cause optimum use of forearm muscles during the rising movement. A friction pad is affixed within an aperture of the coupling for retarding movement of the handle and hold it in a desired position along the vertical support. The brace has a U-shaped bracket for securing the apparatus in a stored position during transport. A pad is affixed within the bracket cradle for sound absorption.

16 Claims, 3 Drawing Sheets

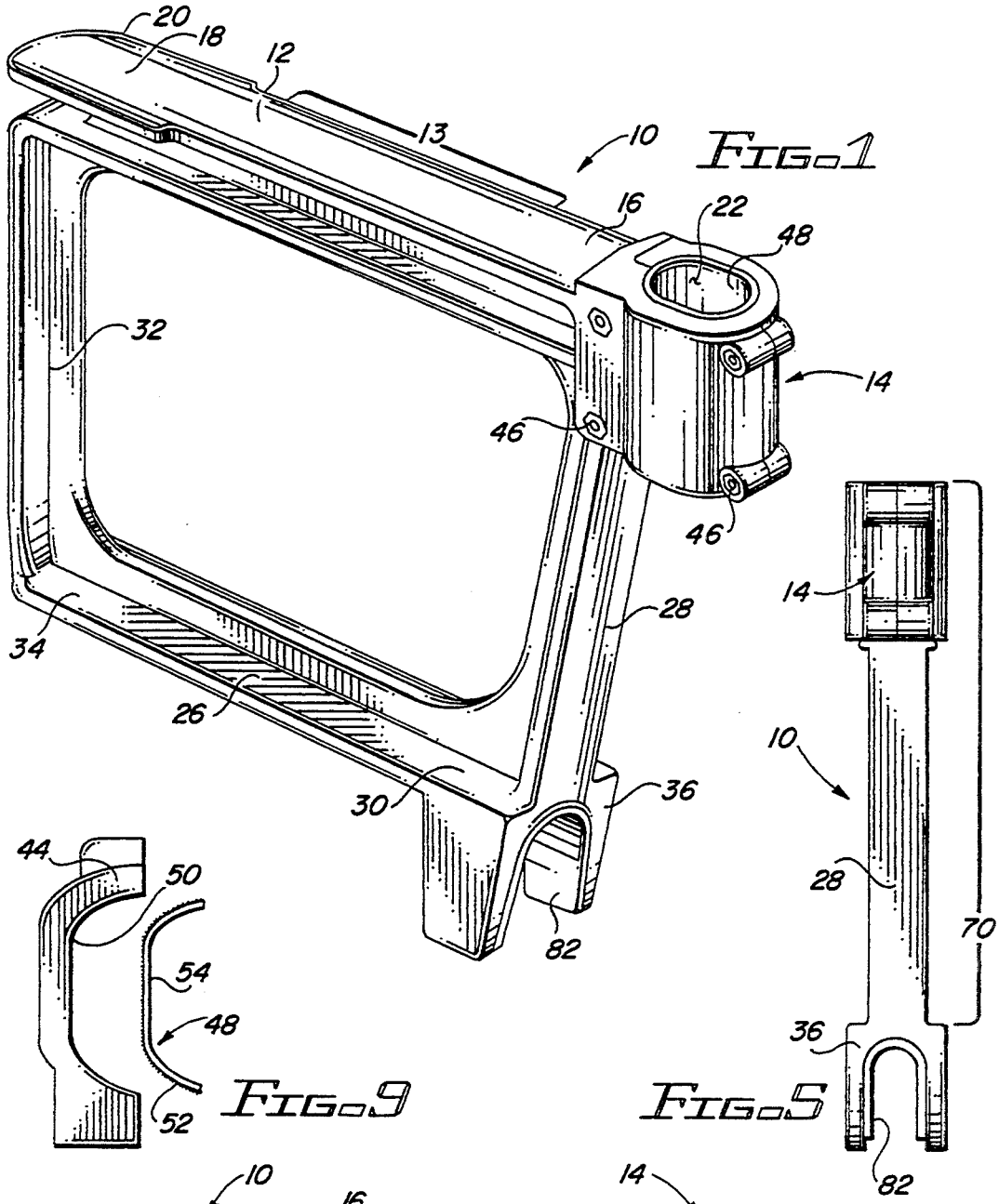
FIG. 1
FIG. 5
FIG. 9
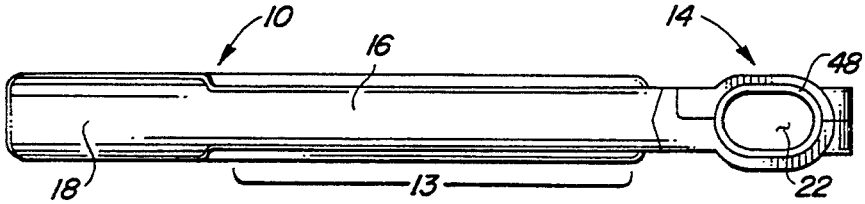
FIG. 2
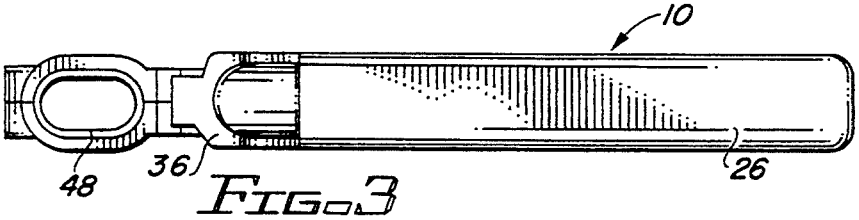
FIG. 3

RISING BRACE AND METHOD FOR AN INVALID WALKER

BACKGROUND OF INVENTION

1. Field of Invention

The present invention relates generally to supports for invalids, and in particular relates to a brace for assisting invalids and elderly in rising to a standing position.

2. Background Art

U.S. Pat. No. 5,005,599 issued on Apr. 9, 1991 to Thomas W. Cunningham discloses a portable aid for assisting an invalid or elderly person in rising from a sitting position. The portable aid includes a portable vertical support and a brace member attached and stored with the portable vertical support. The brace member extends away from the vertical support and has a dimension in the horizontal direction sufficient to extent onto a seat of a chair to permit a sitting person to push downwardly upon the brace member for assistance in rising to a standing position.

The braces consist of a pair of horizontal rods joined to a pivot mechanism attached along the vertical support. The brace member is moved up and down the pivot mechanism within a flanged face. Thus, the brace members are moved from a position for use in assisting in the rising and thus to a position for storage.

The above referenced patent identifies the need to provide stability for a disabled person when they are rising from a sitting position to a standing position. Stability is also needed while that person prepares to advance using devices such as a walker. The walker is typically a lightweight structure that provides disabled persons stability while walking but because of its lightweight cannot be relied upon for pulling that person up from a sitting position or for providing leverage needed in other positions other that standing. The need to aid the disabled person in rising is known and has been addressed in the above referenced disclosure. There is also a need to maintain a stable condition for the disabled person throughout that persons movements, including preparation of assisting devices.

SUMMARY OF INVENTION

A brace for assisting a disabled person in rising from a sitting position to a standing position comprises a handle having a proximal end and a distal end. The handle extends away from a vertical support and has a dimension sufficient for extending over a surface upon which a person is sitting. A coupling affixed to the handle proximal end is rotatably affixed to the vertical support. The coupling has an aperture for loosely receiving the vertical support. A horizontal member having a proximal end and a distal end extends away from the vertical support and has a dimension sufficient for extending onto a supportable surface proximate a person sitting. The horizontal member is generally parallel with the handle and lies in a generally vertical plane passing through the handle. A first strut having an upper end and a lower end is affixed to the handle at the handle proximal end. The lower end is affixed to the horizontal member proximal end. The first strut forms an angle with the handle at the handle proximal end such that the angle formed inclines the first strut away from the vertical support. The angle is sufficient for separating the first strut away from the vertical support as the vertical support is loosely held within the coupling aperture. A second strut is affixed between the handle and horizontal member distal ends. The second and first struts are dimensioned to permit a sitting person to push downwardly upon the handle for assistance in rising to a standing position.

The brace coupling further comprises a friction strip affixed within the coupling aperture. The strip has a thickness sufficient for loosely holding the vertical support passing through the aperture while making frictional contact with the vertical support for holding the brace in a desired position. The strip comprises an adhesive side and a woven loop pile side. The adhesive side is affixed to the coupling within the aperture. The woven loop pile side contacts the vertical support. In the preferred embodiment of the invention, Velcro is used as strip material.

The brace further comprises a bracket affixed to the horizontal member proximal end. The bracket has a general U-shape cradle portion for loosely securing the brace onto a horizontal element communicating with the vertical support. The horizontal element is positioned for permitting a person to walk proximate the element. A strip having an adhesive side and a woven loop pile side is affixed to the bracket within the U-shape portion. The strip has a thickness sufficient for loosely holding the brace and absorbs sounds created during communication of the bracket with the horizontal member. The brace handle further comprises a grip formed at a center portion of the handle. The grip is dimensioned for causing a person holding the grip to use forearm muscles for rising from the sitting position to a standing position.

It is an object of the invention to provide a portable brace for use with a walker that can be positioned for aiding a person in rising from a sitting position to a standing position. It is further an object of the invention to position the brace at desired locations as a further aid in preparation for walking. It is further an object to provide a brace that can be stored within the walker during transport and provide easy access to the brace while allowing the disabled person using the walker to position the brace while maintaining a relatively stable position during the use of the brace.

BRIEF DESCRIPTION OF DRAWINGS

A preferred embodiment of the invention as well as alternate embodiments are described by way of example with reference to the accompanying drawings in which:

FIG. 1 is a perspective view of the preferred embodiment of the invention illustrating a brace having a handle to which a coupling is affixed, a bracket is affixed to a horizontal member, the member separated from a handle of the brace by struts;

FIG. 2 is a top view of the preferred embodiment of FIG. 1 further illustrating a grip of the handle and an oval aperture with the coupling;

FIG. 3 a bottom view of the preferred embodiment of FIG. 1 illustrating a spatial relationship between the bracket and the coupling in the preferred embodiment of FIG. 1;

FIG. 5 is a front view of the preferred embodiment of FIG. 1;

FIG. 9 is a partial cross-sectional view of a second coupling arcuate member illustrating a friction strip in an exploded view with the member;

DETAILED DESCRIPTION OF PREFERRED EMBODIMENT

Figure 4:
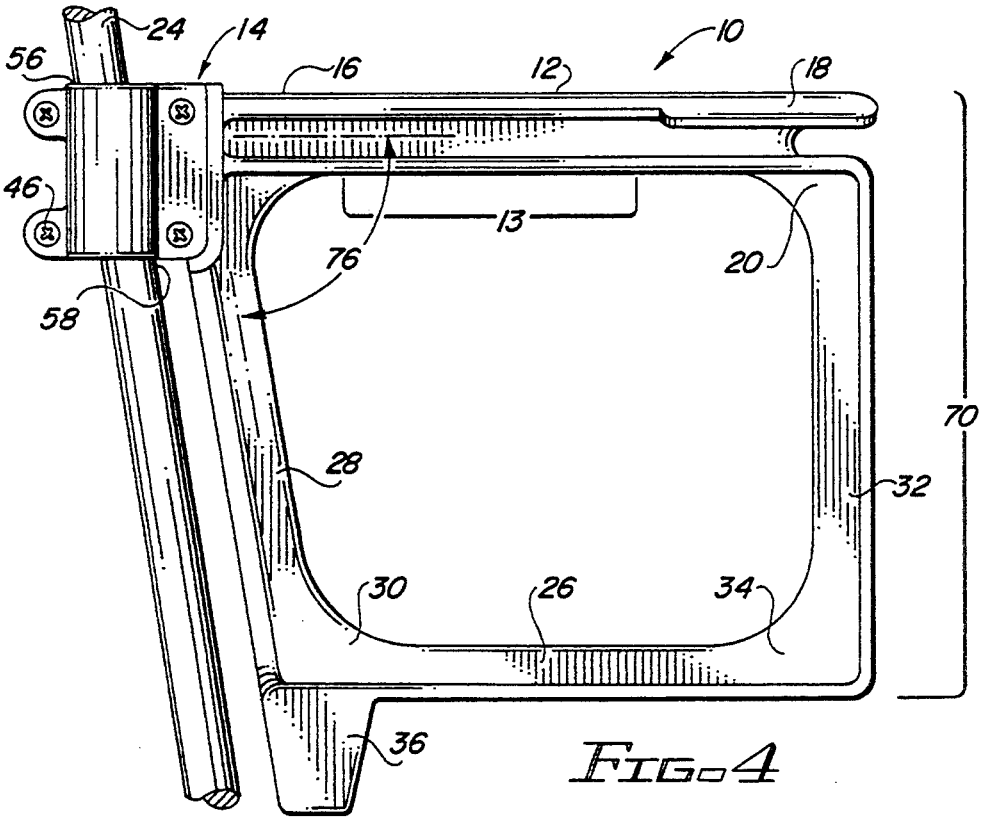
FIG. 4 is a side view of the preferred embodiment illustrating a position of the brace with respect to a vertical support.

A detailed description of a preferred embodiment of the present invention will now be described with reference to FIGS. 1 through 14.

As illustrated in the perspective view of the preferred embodiment of the invention in FIG. 1, a brace 10 has a handle 12 with a coupling 14 affixed to a proximal end 16 of the handle 12. As illustrated in FIG. 1 and further illustrated in FIG. 2, a flanged portion 18 is formed at a distal end 20 of the handle 12. The coupling 14 has an oval aperture 22 passing therethrough as illustrated in the top and bottom views of the brace 10 in FIGS. 2 and 3 respectively. The aperture 22 is sized for loosely receiving a vertical support 24 as illustrated in FIG. 4.

Again with reference to FIG. 1, the brace 10 has a horizontal member 26 parallel to the handle 12 and spaced from the handle 12 using a first vertical strut 28 affixed between the handle proximal end 16 and a horizontal proximal end 30, and a second vertical strut 32 affixed between the handle distal end 20 and a horizontal member distal end 34. The handle 12 is positioned above the horizontal member 26 of the brace for enabling the person to rise from the sitting position. In the preferred embodiment, the vertical struts 28 and 32 are integrally formed with the handle 12 and horizontal member 26 through a molded embodiment of the invention and are dimensioned to place the handle 12 approximately eight inches above the bottom of the horizontal member 26. A grip 13 is formed at a center portion of the handle 12 to cause optimum use of forearm muscles during the rising movement. The flanged portion 18 is formed to cause forward movement of a persons hand to the grip 13. In the preferred embodiment, the grip 13 is formed having a four inch to five inch circumference for comfortable hand gripping use by a typical adult person.

Figure 6:
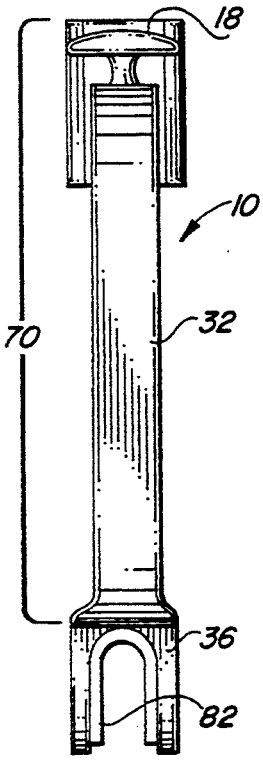
FIG. 6 is a rear view of the preferred embodiment of FIG. 1.
Figure 8:
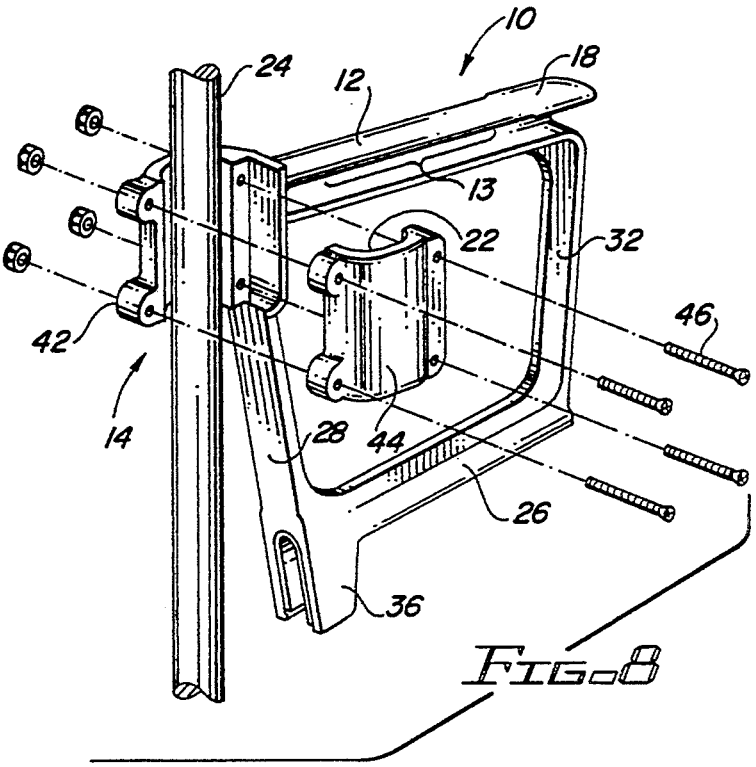
FIG. 8 is a perspective view of the preferred embodiment of the invention of FIG. 1 illustrating arcuate coupling members in an exploded view.
Figure 7:
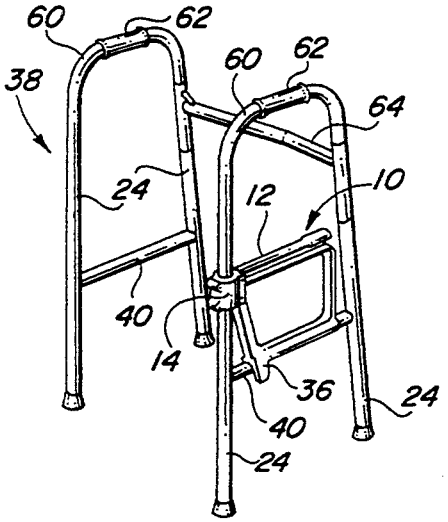
FIG. 7 is a perspective view of a typical walker comprising the brace of the preferred embodiment shown in a storage position.

Again with reference with FIG. 1, a generally U-shaped bracket 36 is integrally formed with the horizontal member 26 and as in FIGS. 1 and 4 and the bracket 36 is formed at the horizontal member proximal end 30 further illustrated in front and rear views of the brace 10 of FIGS. 5 and 6 respectively. As illustrated in FIG. 7, the general U-shape of the bracket 36 permits storage of the brace 10 within a typical walker 38 having the vertical support 24 and a horizontal element 40 affixed to the vertical support 24. The bracket 36 is cradled over the horizontal element 40 during storage of the brace As illustrated in FIG. 8, in the preferred embodiment of the invention, the coupling 14 comprises a first arcuate member 42 integrally formed with the handle 12 and a second arcuate member 44 affixed to the first arcuate member 42 using a nut and bolt assembly 46 for attachment. The arcuate members 42 and 44 communicating to form the oval aperture 22 for receiving the vertical support 24, as illustrated in FIGS. 4 and 7. The oval aperture 22 has a minor diameter dimensioned to hold movement of the struts 28 and 32 generally within a plane of the vertical support 24.

In the preferred embodiment, a friction strip 48 is affixed onto walls of the aperture 22 as illustrated in FIGS. 1–3 and further detailed in FIG. 9. The friction strip 48 causes the brace 10 to remain loosely affixed to the vertical support 24 at any position along the support 24 due to the friction between a strip 48 and the support 24. Walkers 38, as illustrated in FIG. 7, are typically constructed of light tubular metals having smooth surfaces. The vertical support 24 therefore having a somewhat frictionless surface. In the preferred embodiment of the brace 10, molded plastic is used to form the structure of the brace 10. Such structure has a smooth surface as well. In the preferred embodiment, the friction pad 48 is affixed to walls 50 of the aperture 22 formed when the arcuate members 42 and 44 are affixed together. As illustrated in FIG. 9, the friction strip 48 comprises an adhesive surface 52 for affixing the strip 48 to the aperture wall 50 and a frictional surface 54 for making frictional contact with the support 24. Any frictional material such as rubber can be used. In the preferred embodiment, a loop type pile surface has been found to provide sufficient friction yet sufficient sliding over the support. Adhesive backed Velcro strips are readily available as of this writing and provide the frictional strips 48 for the preferred embodiment. As illustrated in FIG. 4, the vertical support 24 loosely passing through the aperture 22 will make partial contact at a top portion 56 and partial contact at a bottom portion 58 of the aperture. As a result, it is important that at least these portions 56 and 58 contain friction strips 48 for maintaining the frictional contact between the coupling 14 and the vertical support 24.

Figure 10:
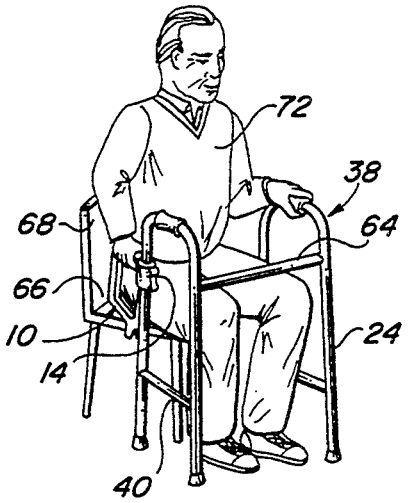
FIG. 10 is a perspective view of a disabled person in a sitting position preparing to rise into a walker using the preferred embodiment of the invention.
Figure 11:
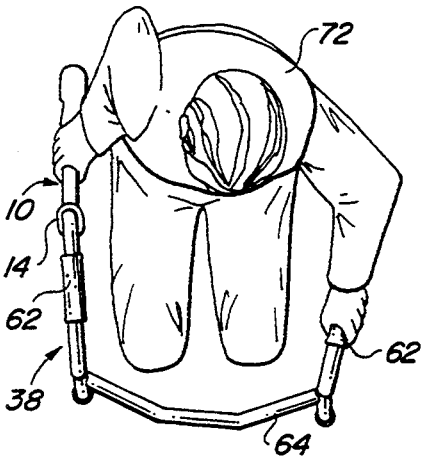
FIG. 11 is a partial top view of the sitting person of FIG. 10.
Figure 12:
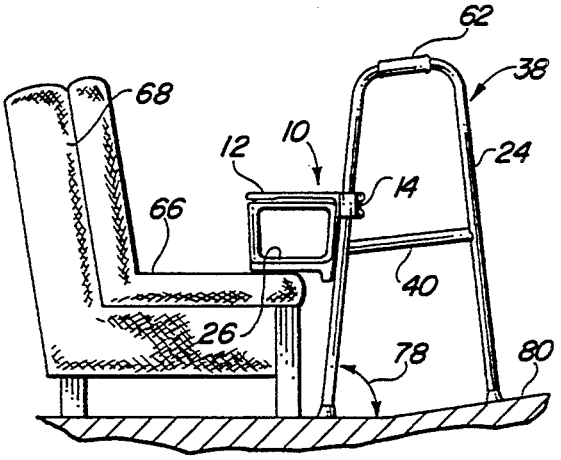
FIG. 12 is a side view of the walker illustrating the brace of the preferred embodiment in a position extended onto a sitting surface of a chair.
Figure 13:
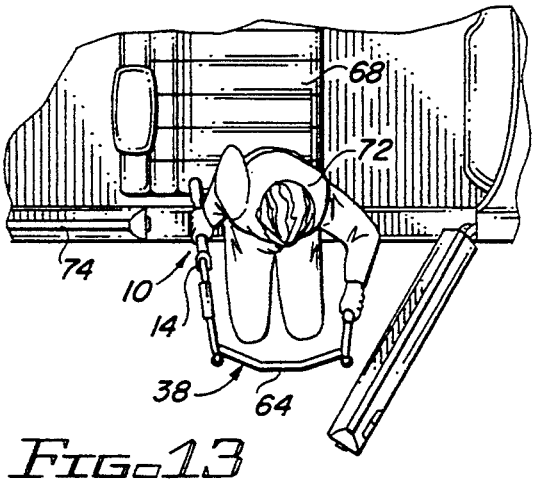
FIG. 13 is a partial top view of a person using the brace of the preferred embodiment with the walker illustrating a further use of the invention while rising from an automobile seat.
Figure 14:
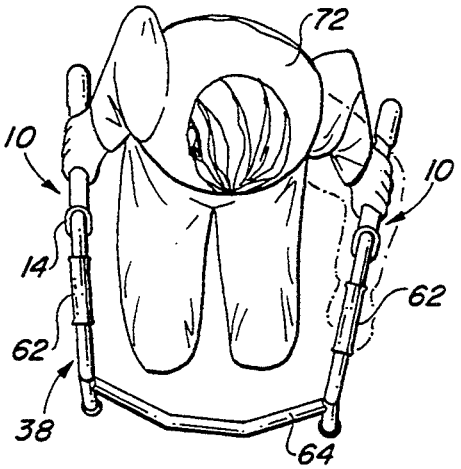
FIG. 14 is a partial top view of a person using the invention wherein a walker comprises two braces.

As illustrated in FIG. 7, the typical walker 38 is provided with two pairs of vertical supports 24 forming legs for the walker 38. Each pair of vertical supports 24 is separated and rigidly constructed with the horizontal elements 40 and upper bridging hand hold 60. Typically, a hand grip 62 is positioned across the upper hand hold 60. Conventionally, the two pairs of vertical supports 24 are joined by a horizontal strut 64 which may be provided with a mechanism (not shown) for collapsing the walker 38 for storage purposes. In accordance with the present invention, the walker 38 is provided with a single brace 10 as shown in the use illustrations of FIGS. 10 through 13, or two braces 10 as illustrated in FIG. 14. With reference to FIGS. 10 and 12, the brace 10 is dimensioned to extend onto a sitting surface 66 of a chair 68. The brace 10 has a vertical height 70 sufficient to permit a person 72 sitting upon the chair 68 to use the brace 10 to rise to a standing position. As described earlier, in the preferred embodiment, a dimension of approximately eight inches is effective. As illustrated in FIG. 13, such a dimension provides the needed height to aid a person 72 rising from a sitting position in an automobile 74 by way of example.

As discussed, the brace 10 is loosely fit around the vertical support 24 and as such is easily moved up and down and around the support 24. The friction strip 48 permits the brace 10 to be placed at desired positions along the support 24 for temporary storage while maneuvering for using the walker 38. The first strut 28 is formed at an angle 76 with the handle 12. The angle 76 is such to permit the brace 10 to be frictionally held to the support 24. The brace 10 falls to a position frictionally held at the top position 56 and the bottom portion 58 from the weight of the brace 10 extending beyond coupler 14. As illustrated in FIG. 12, the support 24 to which the brace 10 is communicating makes other that a right angle 78 with the floor 80, and thus accommodated by the angle 76.

By way of example, reference to FIG. 12 illustrates the brace 10 placed onto the sitting surface 66 of the chair 68. It will be appreciated that the construction and dimension of the brace 10 is such to permit an elderly or disabled person sitting upon the surface 66 to push down upon the handle 12 of the brace 10 without causing the walker 38 to tip over and thus permit the person after rising to step into a walking area of the walker 38 as further illustrated in FIGS. 10, 11, 13 and 14. The friction strip 48 will cause the brace 10 to remain in the approximate position when used in rising as the walker 38 is maneuvered away from the chair 68, the handle to first strut angle 76 keeping the brace 10 out of contact with the vertical support 24 except at the friction strip 48 contact points as discussed. After use in rising, the brace 10 may be moved about the vertical support 24 and in rotation to within a plane of the vertical supports 24 and horizontal element 40, where the brace 10 is lowered so as to cause the bracket 36 to cradle the horizontal element 40 for storing the brace 10 when not in use as illustrated in FIG. 7. In the preferred embodiment of the invention, a strip 82 is affixed within the U-shaped inner walls of the bracket 36 as illustrated in FIGS. 5 and 6 to absorb noise created as the brace 10 loosely resting on the horizontal element 40 rattles about while the walker 38 is being maneuvered. Velcro as described earlier is a convenient choice for the strip 82.

While a specific embodiment of the invention has been described in detail herein above with a typical walker 38, it is to be understood that various modifications may be made from the specific details described herein without departing from the spirit and scope of the invention as set forth in the appended claims. For example, the brace 10 may be stored under the arm rest of a wheel chair, and may be rotated outwardly as required to permit a person sitting upon the wheelchair to first rise and then sit in the wheel chair, with subsequent storage of the brace 10 in a manner similar to that described above. Likewise, although a walker 38 has been used by way of example, a cane, post or crutch can provide the vertical support 24 with which the brace 10 communicates.

Having now described the invention, the brace construction, the operation and use of the preferred embodiment thereof, and the advantageous new and useful results obtained thereby, the new and useful constructions, and reasonable mechanical equivalents thereof obvious to those skilled in the art, are set forth in the appended claims.

What is claimed is:

1. A brace for assisting a disabled person in rising from a sitting position to a standing position, the brace comprising:

a portable vertical support;

a handle having a proximal end and a distal end, the handle extending away from the vertical support and having a dimension sufficient for extending over a surface upon which a person is sitting;

a coupling affixed to the handle proximal end, the coupler rotatably affixed to the vertical support, the coupling having an aperture for loosely receiving the vertical support, the coupling further comprises a friction strip affixed within the coupling aperture, the strip having a thickness sufficient for loosely holding the vertical support passing through the aperture, the strip making frictional contact with the vertical support sufficient to hold the brace in a desired position;

a horizontal member having a proximal end and a distal end, the horizontal member extending away from the vertical support and having a dimension sufficient for extending onto a support surface;

a first strut having an upper end and a lower end, the upper end affixed to the handle proximate the handle proximal end, the lower end affixed to the horizontal member proximal end, the first strut forming an angle with the handle at the handle proximal end, the angle formed for inclining first the strut away from the vertical support, the angle sufficient for separating the first strut away from the vertical support as the vertical support is loosely held within the coupling aperture; and a second strut affixed between the handle and horizontal member distal ends, the second and first struts dimensioned for permitting a sitting person to push downwardly upon the handle for assistance in rising to a standing position.

2. The brace as recited in claim 1, wherein the strip comprises an adhesive side and a loop pile side, the adhesive side affixed to the coupling within the aperture, the loop pile side contacting the vertical support.

3. The brace as recited in claim 1, further comprising a bracket affixed to the horizontal member proximal end, the bracket having a general U-shape for loosely securing the brace onto a horizontal element communicating with the vertical support.

4. The brace as recited in claim 3, further comprising a strip affixed to the bracket within the U-shape portion.

5. The brace as recited in claim 1, further comprising a grip formed at a handle central portion, the grip having a dimension for causing a person holding the grip to use forearm muscles for rising from the sitting position to a standing position.

6. The brace as recited in claim 5, wherein the grip is dimensioned to have an effective circumference of between four inches and five inches.

7. The brace as recited in claim 1, wherein the coupling aperture comprises an oval shape for loosely receiving the vertical support, the aperture having a minor diameter for generally restricting lateral movement of the struts to proximate a plane of the vertical support.

8. A method for enabling a disabled person to rise unassisted from a sitting position to a walking position, the method comprising the steps of:

providing a portable, generally vertical support;

extending a handle away from the vertical support and over a support surface, the handle having a proximal end and a distal end;

rotatably coupling the handle to the vertical support, the coupling having an aperture for loosely receiving the vertical support;

extending a horizontal member having a proximal end and a distal end away from the vertical support, the horizontal member having a dimension sufficient for extending onto the support surface the horizontal member generally parallel with the handle and lying in a generally vertical plane passing through the handle;

affixing a first strut between the handle and the horizontal member;

forming an angle between the first strut and the handle at the handle proximal end, the angle for inclining the strut away from the vertical support, the angle sufficient for separating the first strut away when loosely holding the vertical support within the coupling aperture;

affixing a second strut between the handle and horizontal member;

dimensioning the first and second struts for permitting a sitting person to push downwardly upon the handle for assistance in rising to a standing position;

affixing a friction strip within the coupling aperture, the strip having a thickness sufficient for loosely holding the vertical support passing through the aperture;

slideably adjusting the handle along the vertical support to a desired position, the coupling strip making frictional contact with the vertical support sufficient for holding the brace in the desired position; and readjusting the handle to another desired position.

9. The method as recited in claim 8, wherein the vertical support comprises first and second vertical supports and wherein the adjusting step further comprises the steps of:

rotating the handle to a position between the two vertical supports; and slideably adjusting the handle for storing between the vertical supports.

10. The method as recited in claim 8, further comprising the steps of:

affixing a bracket to the horizontal member proximal end;

forming the bracket in a generally U-shape for loosely securing the brace onto a horizontal element communicating with the vertical support;

securing the brace onto the horizontal element for storage of the brace.

11. The method as recited in claim 10, further comprising the step of affixing a strip to the bracket within the U-shape portion, the strip having a thickness sufficient for loosely holding the brace and for absorbing sound created by the bracket contacting the vertical support.

12. The method as recited in claim 8, further comprising the steps of:

forming a grip at a center portion of the handle; and dimensioning the grip for causing a person holding the grip to use forearm muscles for rising from the sitting position to a standing position;

holding the grip; and rising from a sitting position to a standing position using forearm muscles.

13. The method as recited in claim 12, further comprising the step of forming the grip into a shape having an effective gripping circumference between four inches and five inches.

14. The method as recited in claim 8, wherein the coupling aperture is formed into an oval shape for loosely receiving the vertical support, the aperture having a minor diameter for generally restricting lateral movement of the struts to proximate a plane of the vertical support.

* * * * *